US006901756B2

(12) United States Patent
Gerendas et al.

(10) Patent No.: US 6,901,756 B2
(45) Date of Patent: Jun. 7, 2005

(54) DEVICE FOR THE INJECTION OF FUEL INTO THE FLOW WAKE OF SWIRLER VANES

(75) Inventors: Miklos Gerendas, Zossen (DE); Thomas Doerr, Berlin (DE)

(73) Assignee: Rolls-Royce Deutschland Ltd & Co KG, Dahlewitz (DE)

( * ) Notice: Subject to any disclaimer, the term of this patent is extended or adjusted under 35 U.S.C. 154(b) by 0 days.

(21) Appl. No.: 10/287,718

(22) Filed: Nov. 5, 2002

(65) Prior Publication Data

US 2003/0084667 A1 May 8, 2003

(30) Foreign Application Priority Data

Nov. 5, 2001 (DE) ..... 101 54 282

(51) Int. Cl.[7] ..... F23R 3/14
(52) U.S. Cl. ..... 60/740; 60/748
(58) Field of Search ..... 60/737, 738, 740, 60/748

(56) References Cited

U.S. PATENT DOCUMENTS 3,608,831 A * 9/1971 Place et al. ..... 60/748
5,165,241 A 11/1992 Joshi et al.
5,251,447 A 10/1993 Joshi et al.
5,511,375 A 4/1996 Joshi et al.
6,141,967 A 11/2000 Angel et al.
6,301,899 B1 * 10/2001 Dean et al. ..... 60/748
6,367,262 B1 * 4/2002 Mongia et al. ..... 60/748
2001/0023590 A1 9/2001 Mandai et al.

FOREIGN PATENT DOCUMENTS

| | | |
|---|---|---|
| DE | 3819898 | 12/1989 |
| DE | 19532264 | 3/1997 |
| EP | 0500256 | 8/1992 |
| EP | 0561591 | 9/1993 |
| EP | 0870989 | 10/1998 |

OTHER PUBLICATIONS

Hughes et al. Theory and Problems of Fluid Dynamics. McGraw Hill, 1967. p. 7.*
European Search Report dated May 10, 2004.

* cited by examiner

*Primary Examiner*—Louis J. Casaregola
(74) *Attorney, Agent, or Firm*—Harbin King & Klima

(57) ABSTRACT

A device for the injection of fuel into the combustion chamber of a gas turbine includes at least one swirler (1) arranged in an air path with at least one swirler vane (2) and with at least one fuel injection nozzle (3), wherein the fuel injection nozzle (3) is arranged in a wake area of the swirler vane (2) and is separate from the swirler vane (2).

20 Claims, 2 Drawing Sheets

DEVICE FOR THE INJECTION OF FUEL INTO THE FLOW WAKE OF SWIRLER VANES

This invention claims priority to German Patent Application DE10154282.8, filed Nov. 5, 2001, the entirety of which is incorporated by reference herein.

BACKGROUND OF THE INVENTION

This invention relates to a device for the injection of fuel into the combustion chamber of a gas turbine having at least one swirler arranged in an air path with at least one swirler vane and with at least one fuel injection nozzle.

According to the state-of-the-art, the fuel must be mixed with the compressed air to enable subsequent combustion in the combustion chamber of a gas turbine. For this purpose, at least one, two or three air paths and at least one fuel path are provided in the burner. A swirler is frequently arranged in the air path and it can be of the axial, diagonal or radial type. In the burner, the air and the fuel are mixed appropriately. In the process, the fuel is either introduced in the form of a thin lamella or a lamella-type stream between two possibly swirled air streams or transported by an air stream to an atomiser edge as a thin film. Here, the fuel lamella or the fuel film are atomised and mixed with the air.

In an alternative approach, several radial, diagonal or axial injection holes are provided through which the fuel is introduced into the air stream from a central or annular body or from a swirler vane.

A design of the said type is shown in Specification DE 195 32 264 A1, for example.

As long as the swirlers and the respective geometrical dimensions are small, the fuel jets will mix well with the air. Here, a stoichiometrically lean mixture in the flame allows pollution emission, e.g. nitrogen oxides, to be reduced. To obtain this lean mixture in the primary zone, the flow cross-section of the burners was increased and the amount of dilution air from the dilution-air ports of the flame tube was constantly reduced in the past.

It was found, however, that a further increase of the flow cross-section is not accompanied by a corresponding reduction of the pollution emission, for example the nitrogen oxide emission, if a certain flow area of the burner is exceeded. This is due to the fact that the mixing process of fuel and combustion air will depreciate the more the flow cross-section of the burner is increased. If the burner flow areas are very large, a major portion of the air will no longer be involved in the mixing process with the fuel.

With the state-of-the-art pressure ratios currently employed for gas turbines, the penetration depth of the fuel jets is very limited; it amounts to a few millimetres only, for example to 6 mm. Accordingly, the size of the usable flow area of the burner is very much confined if fuel injection is accomplished from a central or annular body. Injection of fuel from a swirler vane greatly increases the surface of the fuel-guiding components. Consequently, these must be actively cooled to cater for the currently employed compressor exit temperatures. This increases the engineering effort as well as the costs and the failure probability.

BRIEF SUMMARY OF THE INVENTION

A broad aspect of the present invention is to provide a device for fuel injection of the type cited at the beginning which ensures a good mixture of the fuel with the air supplied and which is simply designed and safe to operate while avoiding the disadvantages known in the state-of-the-art.

It is a particular object of the present invention to provide a solution for the above problems in accordance with the present invention as described herein, with further advantageous developments of the present invention becoming apparent from the description below.

Accordingly, the present invention provides for the arrangement of at least one fuel injection nozzle in the wake of the swirler vane, with the nozzle being separate from the swirler vane, i.e., not being arranged on the vane itself.

The present invention is characterized by a variety of merits.

According to the present invention, fuel is injected into the wake of the axial, diagonal or radial swirler vanes via radial, diagonal or axial holes or nozzles. This ensures a significant increase of the penetration depth of the fuel jets compared with the state-of-the-art, since they are less easily broken up by the high relative velocity of air and fuel. Thus, it will be possible to efficiently mix a much larger air mass flow with fuel in a burner. This enlarged flow area of the burners, together with the ability to adjust the fuel distribution in the burner air, allows the pollution emissions to be drastically reduced. The larger usable flow area of an individual burner also enables the number of burners in a gas turbine to be reduced, if applicable. This results in savings of weight and cost.

In a particularly favourable development of the present invention, the fuel injection nozzle is arranged in the area of the trailing edge of the swirler vane. This aerodynamically favourable arrangement enables the fuel to be injected into the air wake formed by the boundary layer on the swirler vane. The considerably lower flow velocity in the wake allows a significantly deeper penetration of the fuel jets.

It is particularly advantageous to provide a contoured form of the trailing edge of the swirler vane. This contour enables the distribution of fuel in the air stream to be controlled. Over a certain path which is controlled by the contour, the fuel jet is protected by the swirler vane. At a suitable point, a recess is provided on the trailing edge of the vane. It causes the fuel jet to be suddenly subjected to a higher aerodynamic load, so that a very large amount of fuel is introduced into the air stream at the wall clearance of the recess. By selecting the angle and the wall clearance of the recess, fuel distribution in the air can be adjusted appropriately.

In a further, also particularly favourable development of the present invention, a form of swirler vane is provided which is contoured as regards its cross-section or thickness. The fuel injection along the thickened trailing edge of the swirler vane protects the fuel jet over a certain path, allowing it to penetrate the air stream for a defined depth. At a suitable point, the trailing edge of the swirler vane is reduced in thickness, this causing the fuel jet to be subjected to a higher aerodynamic load and the fuel to be introduced into the air stream over the length of the tapered section. By development of the thickness of the trailing edge of the vane normal (vertical) to the wall, the distribution of fuel in the air can be designed appropriately.

It is understood that the above forms of contouring may be used in combination at the same time.

BRIEF DESCRIPTION OF THE DRAWINGS

This invention is more fully described in the light of the accompanying drawings showing embodiments of the present invention. On the drawings.

DETAILED DESCRIPTION OF THE INVENTION

Figure 1:
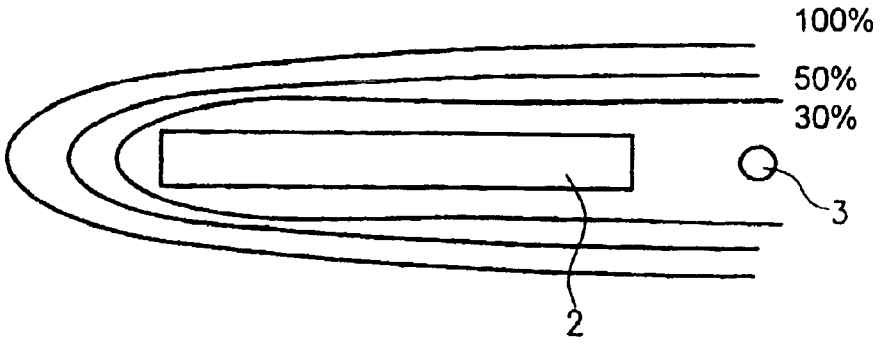
FIG. 1 is a schematic top view of the fuel injection according to the present invention in the wake area of a swirler vane.

FIG. 1 shows in highly simplified form a swirler vane 2 of a swirler, with the flow boundary layers and the air velocity ranges being shown. The percentages each refer to the maximum possible airflow velocities, i.e. the velocity of attack.

Reference numeral 3 indicates a fuel injection nozzle in schematic form which is positioned in the flow wake area of the swirler vane 2. As is shown, the fuel jet is in an area of reduced airflow velocity (100% corresponds to the velocity of attack). This aerodynamically favourable arrangement enables the fuel to be injected into the air wake formed by the boundary layer on the swirler vane. The considerably lower flow velocity in the wake allows a significantly deeper penetration of the fuel jets.

Figure 2:
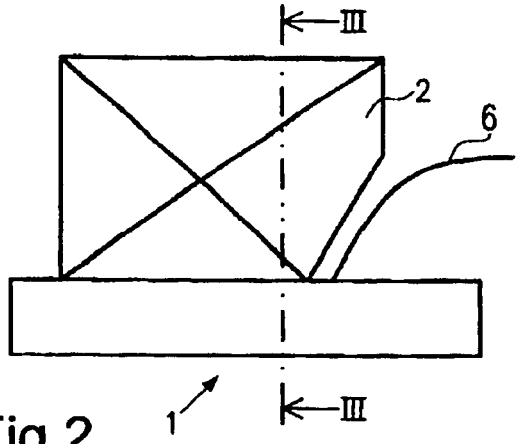
FIG. 2 is a simplified, schematic side view of a swirler vane with a contoured trailing edge.
Figure 3:
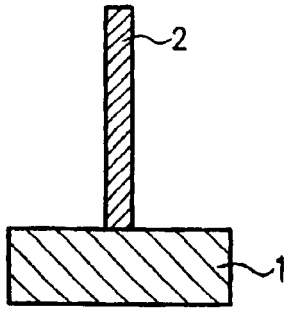
FIG. 3 is a sectional view along the line III—III of FIG. 2.

FIGS. 2 and 3 show the possibility of contouring (recessing or tapering) the trailing edge of the swirler vane 2 and positioning the fuel injection nozzle 3 so as to be protected by the contoured trailing edge. This contour enables the distribution of fuel in the air stream to be controlled. Over a certain path which is controlled by the contour, the fuel jet is protected by the recessed trailing edge of the swirler vane. This causes the fuel jet to be suddenly subjected to a higher aerodynamic load when leaving the recessed area of the trailing edge, so that a very large amount of fuel is introduced into the air stream at the wall clearance of the recess. By selecting the angle and the wall clearance of the recess, fuel distribution in the air can be adjusted appropriately. Curve 6, in simplified form, represents the development of the fuel jets from the fuel injection nozzle(s) 3 (not visible, but at the base of the fuel jet curve 6) when exposed to the air flow.

Figure 4:
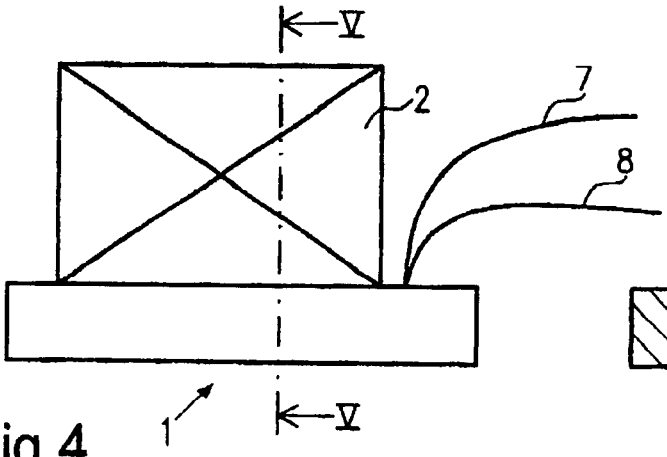
FIG. 4 is a side view, similar to FIG. 2, of a further embodiment of a swirler vane with thickness contouring.
Figure 5:
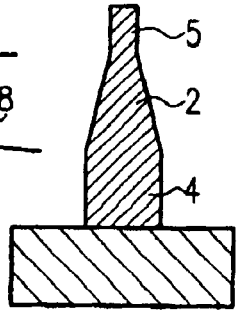
FIG. 5 is a side view along the line V—V of FIG. 4.

A further example of a contoured swirler vane 2 is shown in FIGS. 4 and 5. The swirler vane is considerably thicker (in cross-section) in its root area 4 than in its tip area 5. The fuel injection along the thickened trailing edge of the swirler vane (root area 4) protects the fuel jet over a certain path, allowing it to penetrate the air stream for a defined depth. At a suitable point, the trailing edge of the swirler vane is reduced in thickness (tip area 5), this causing the fuel jet to be subjected to a higher aerodynamic load and the fuel to be introduced into the air stream at this point over the length of the tapered section. By development of the thickness of the trailing edge of the vane normal (vertical) to the wall, the distribution of fuel in the air can be designed appropriately. Here, the curves 7 and 8 represent the outer and inner boundaries of the fuel spray, respectively.

Figure 6:
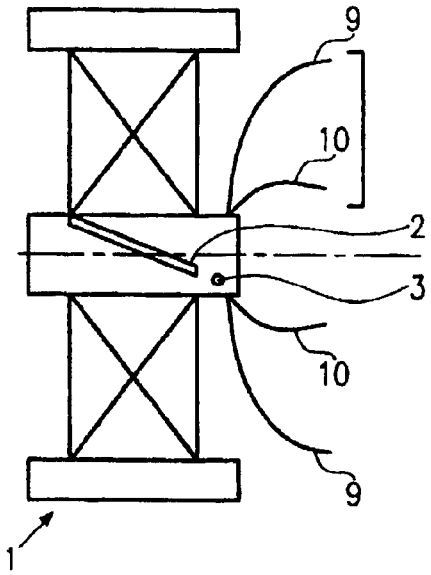
FIG. 6 is a representation of an axial swirler in accordance with the present invention.

FIG. 6 shows an axial swirler with improved fuel introduction. The bracket represents the two boundary curves of the fuel jet distribution (9 is the outer boundary curve, 10 is the inner boundary curve) in simplified form. It appears that the fuel is distributed uniformly in the air stream over actually the entire effective area of the swirler 1.

Figure 7:
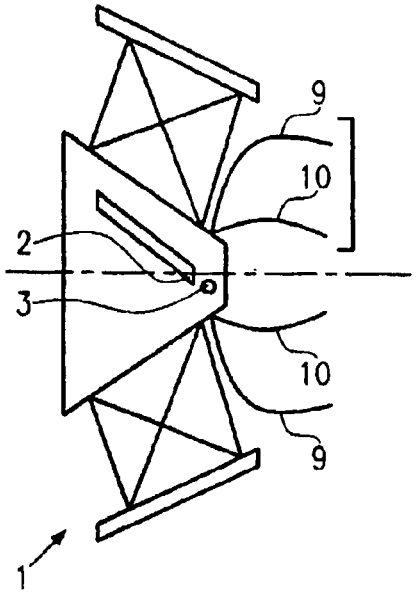
FIG. 7 is a simplified representation of an embodiment of a diagonal swirler in accordance with the present invention.

FIG. 7 shows a diagonal swirler of the type according to the present invention. Here again, the fuel boundary curves 9 and 10 (represented by the bracket) indicate the area in which the fuel is distributed.

Figure 8:
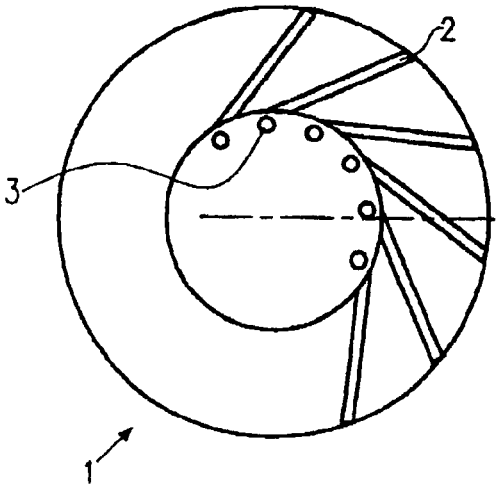
FIG. 8 is a schematic front view of an embodiment of a radial swirler in accordance with the present invention.
Figure 9:
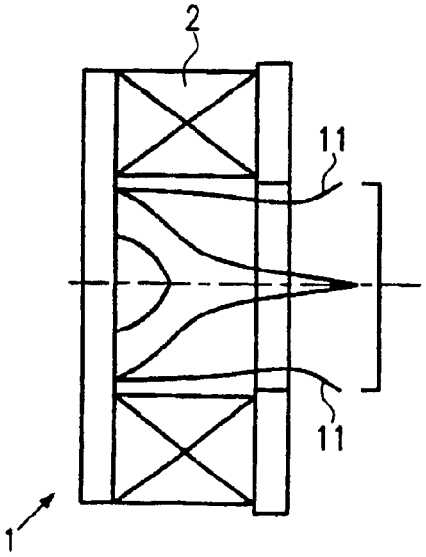
FIG. 9 is a side view of the arrangement shown in FIG. 8, partly in section.

FIG. 8 is a radial swirler of the type according to the present invention. One fuel injection nozzle 3 is related to each swirler vane 2. In the side view of FIG. 9, the fuel boundary curves 11 (in connection with the bracket) indicate the fuel distribution area.

It is apparent that a plurality of modifications other than those described herein may be made without departing from the inventive concept.

What is claimed is:

1. A device for the injection of fuel into the combustion chamber of a gas turbine having at least one swirler arranged in an air path with at least one swirler vane and at least one fuel injection nozzle, wherein the swirler vane has a trailing edge that is contoured, and the fuel injection nozzle is positioned separately from the swirler vane on a sidewall of the swirler in a wake area of the swirler vane near the trailing edge, the nozzle positioned to inject fuel generally in a same direction as the contoured portion of the trailing edge near the sidewall of the swirler.

2. A device in accordance with claim 1, wherein the fuel injection nozzle is positioned in an area of the air path between boundary layers of opposing sides of the swirler vane.

3. A device in accordance with claim 2, wherein the trailing edge of the swirler vane is tapered in a direction of air flow.

4. A device in accordance with claim 3, wherein the swirler vane has a contoured cross-section.

5. A device in accordance with claim 4, wherein the trailing edge of the swirler vane has a greater width in its root area than in its tip area.

6. A device in accordance with claim 1, wherein the fuel injection nozzle is positioned in an area of the air path between boundary layers of opposing sides of the swirler vane.

7. A device in accordance with claim 6, wherein the trailing edge of the swirler vane is tapered in a direction of air flow.

8. A device in accordance with claim 1, wherein the trailing edge of the swirler vane is tapered in a direction of air flow.

9. A device in accordance with claim 1, wherein the swirler vane has a contoured cross-section.

10. A device in accordance with claim 9, wherein the trailing edge of the swirler vane has a greater width in its root area than in its tip area.

11. A device in accordance with claim 1, wherein the trailing edge of the swirler vane has a greater width in its root area than in its tip area.

12. A device in accordance with claim 1, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

13. A device in accordance with claim 2, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

14. A device in accordance with claim 4, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

15. A device in accordance with claim 6, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

16. A device in accordance with claim 7, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

17. A device in accordance with claim 8, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

18. A device in accordance with claim 11, wherein the trailing edge of the swirler vane has a recessed portion near the sidewall extending upstream from a position on the trailing edge radially distant from the sidewall to a position on the trailing edge radially near the sidewall and the fuel nozzle is positioned below this recessed portion.

19. A device for the injection of fuel into the combustion chamber of a gas turbine having at least one swirler arranged in an air path with at least one swirler vane and at least one fuel injection nozzle, wherein a trailing edge of the swirler vane has a recessed portion near a sidewall of the swirler extending upstream from a position on the trailing edge radially distant from the sidewall to a position on the trailing edge radially near the sidewall and the fuel nozzle is positioned separately from the swirler vane below this recessed portion in a wake area of the swirler vane.

20. A device in accordance with claim 19, wherein the fuel injection nozzle is positioned to inject fuel generally in a same direction as the contoured portion of the trailing edge near the sidewall of the swirler.

* * * * *